US010654282B2

(12) United States Patent
Hayashi

(10) Patent No.: US 10,654,282 B2
(45) Date of Patent: May 19, 2020

(54) LIQUID SUPPLYING SYSTEM HAVING SENSOR FOR SENSING LIQUID LEVEL IN TANK STORING LIQUID FOR SUPPLYING TO HEAD

(71) Applicant: BROTHER KOGYO KABUSHIKI KAISHA, Nagoya-shi, Aichi-ken (JP)

(72) Inventor: Masahiro Hayashi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 16/299,943

(22) Filed: Mar. 12, 2019

(65) Prior Publication Data

US 2019/0299644 A1 Oct. 3, 2019

(30) Foreign Application Priority Data

Mar. 30, 2018 (JP) ..... 2018-067488

(51) Int. Cl.
*B41J 2/175* (2006.01)

(52) U.S. Cl.
CPC ..... *B41J 2/17566* (2013.01); *B41J 2/17513* (2013.01); *B41J 2/17553* (2013.01); *B41J 2002/17573* (2013.01)

(58) Field of Classification Search
CPC ..... B41J 2/17566; B41J 2002/17573
See application file for complete search history.

(56) References Cited

U.S. PATENT DOCUMENTS 6,460,962 B1 * 10/2002 Dietl ..... B41J 2/17513 347/19
6,520,612 B1 * 2/2003 Merz ..... B41J 2/17546 347/7
2002/0024543 A1 * 2/2002 Kimura ..... B41J 2/17509 347/7
2004/0246283 A1 * 12/2004 Merz ..... B41J 2/17566 347/7
2009/0201351 A1 8/2009 Shimizu et al.
2011/0310199 A1 * 12/2011 Kanbe ..... B41J 2/17566 347/86
2013/0016153 A1 * 1/2013 Yamaguchi ..... B41J 2/17566 347/19

FOREIGN PATENT DOCUMENTS

EP 1254775 A2 * 11/2002 ..... B41J 2/17513
JP 2008-238792 10/2008

* cited by examiner

*Primary Examiner* — Julian D Huffman
(74) *Attorney, Agent, or Firm* — Merchant & Gould P.C.

(57) ABSTRACT

A liquid supplying system includes a cartridge, a tank, and a detecting portion. The liquid stored in a first storage chamber of the cartridge is flowed into a second storage chamber of the tank through an inlet opening. The liquid stored in the second storage chamber is discharged through an outlet opening. The second storage chamber includes a first portion, a second portion, and a third portion. The second portion is positioned below the first portion and has a horizontal cross-sectional area greater than a horizontal cross-sectional area of the first portion. The third portion is positioned above the first portion and has a horizontal cross-sectional area greater than a horizontal cross-sectional area of the first portion. The outlet opening is in communication with the second portion. The detecting portion is configured to detect the level of liquid stored in the first portion.

18 Claims, 10 Drawing Sheets

LIQUID SUPPLYING SYSTEM HAVING SENSOR FOR SENSING LIQUID LEVEL IN TANK STORING LIQUID FOR SUPPLYING TO HEAD

CROSS REFERENCE TO RELATED APPLICATION

This application claims priority from Japanese Patent Application No. 2018-067488 filed Mar. 30, 2018. The entire content of the priority application is incorporated herein by reference.

TECHNICAL FIELD

The present disclosure relates to a liquid supplying system having a liquid level sensor for sensing a liquid level in a tank storing liquid. The liquid in the tank is supplied from a liquid cartridge and supplied to a liquid ejecting head.

BACKGROUND

United State Patent Application Publication No. 2009/0201351A1 discloses a system capable of supplying a liquid from a cartridge to a tank owing to hydraulic head pressure, and then supplying the liquid from the tank to a head (consumption device) configured to consume the liquid. In the system disclosed in United State Patent Application Publication No. 2009/0201351A1, a sensor detects a sensor arm provided in the cartridge to detect an amount of the liquid remaining in the cartridge.

SUMMARY

Another system is conceivable in which a liquid is supplied from a cartridge to a tank relying upon hydraulic head pressure but an amount of the liquid remaining in the tank is detected, rather than directly detecting the amount of liquid in the cartridge. The liquid in the tank is detected using a sensor, and the liquid remaining in the cartridge is assumed to be an amount of liquid corresponding to the amount liquid in the tank. With such a system, the following problems may occur.

In the system described above, when the liquid is supplied from the tank to the head, a level of the liquid in the tank may temporarily be lowered as compared with a level of the liquid in the cartridge. Despite the fact that the amount of the liquid remaining in the cartridge is greater than the predetermined amount, the system may detect that an amount of the liquid in the cartridge is lower than the predetermined amount. This is due to the use of the sensor detecting the level of the liquid in the tank. Consequently, the amount of the remaining liquid in the cartridge is erroneously detected.

In view of the problems described above, an object of the present disclosure to provide a system capable of detecting an amount of a liquid remaining in a tank, with lesspossibility of erroneous detection of the amount of the remaining liquid.

In order to attain the above and other objects, according to one aspect, the disclosure provides a liquid supplying system including a cartridge, a tank to which the cartridge is connectable, and a detecting portion. The cartridge includes a first storage chamber and a first air communicating portion. The first storage chamber configured store liquid therein. The first air communicating portion allowing the first storage chamber to communicate with an atmosphere. The tank includes a second storage chamber, an inlet opening, an outlet opening, and a second air communicating portion. The second storage chamber is configured to store the liquid therein. The liquid stored in the first storage chamber of the cartridge connected to the tank is flowed into the second storage chamber through the inlet opening. The liquid stored in the second storage chamber is discharged through the outlet opening. The second air communicating portion allow the second storage chamber to be communicated with the atmosphere. The detecting portion is configured to detect that the liquid stored in the second storage chamber becomes a predetermined level in a vertical direction. The second storage chamber includes a first portion, a second portion, and a third portion. The second portion is positioned below the first portion and has a horizontal cross-sectional area greater than a horizontal cross-sectional area of the first portion. The third portion is positioned above the first portion and has a horizontal cross-sectional area greater than a horizontal cross-sectional area of the first portion. The outlet opening is in communication with the second portion. The detecting portion is configured to detect the level of liquid stored in the first portion.

BRIEF DESCRIPTION OF THE DRAWINGS

The particular features and advantages of the embodiment as well as other objects will become apparent from the following description taken in connection with the accompanying drawings, in which.

DETAILED DESCRIPTION

Figure 1A:
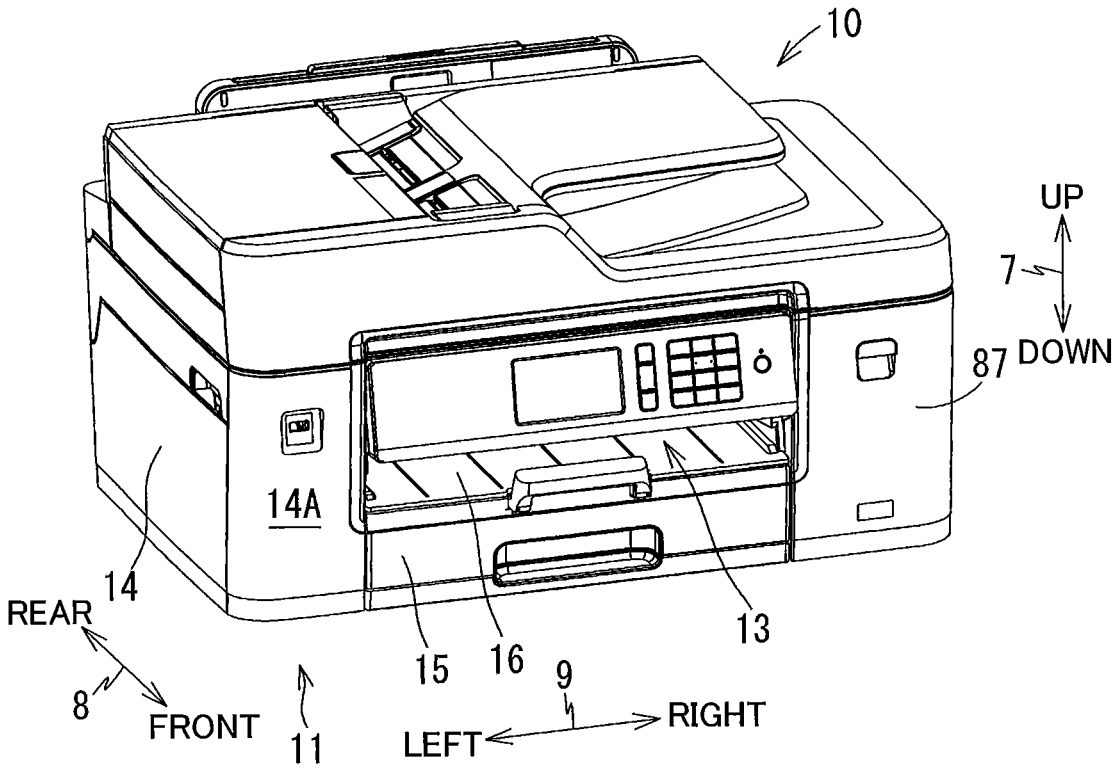
FIG. 1A is a perspective view of a multifunction peripheral according to an embodiment of the present disclosure, in which a cover of the multifunction peripheral is at a closed position.

A multifunction peripheral 10 as an example of a liquid supplying system according to one embodiment will be described with reference to FIGS. 1 through 10, wherein like parts and components are designated by the same reference numerals to avoid duplicating description.

In the following description, up, down, front, rear, left, and right directions related to the multifunction peripheral 10 will be referred to assuming that the multifunction peripheral 10 is disposed on a horizontal plane so as to be operable, as shown in FIG. 1A. Note that this posture of the multifunction peripheral 10 illustrated in FIG. 1A will also be referred to as an "operable posture". Specifically, an up-down direction 7 of the multifunction peripheral 10 will be defined based on the operable posture of the multifunction peripheral 10. A front-rear direction 8 will be defined assuming that a surface of the multifunction peripheral 10 formed with an opening 13 is a front surface of the multifunction peripheral 10 in the operable posture. A left-right direction 9 will be defined based on an assumption that the multifunction peripheral 10 in the operable posture is viewed from its front side. In the present embodiment, in the operable posture of the multifunction peripheral 10, the up-down direction 7 is parallel to a vertical direction, and the front-rear direction 8 and the left-right direction 9 are parallel to a horizontal direction. Further, the front-rear direction 8 is perpendicular to the left-right direction 9.

<Overall Structure of Multifunction Peripheral 10>

Figure 1B:
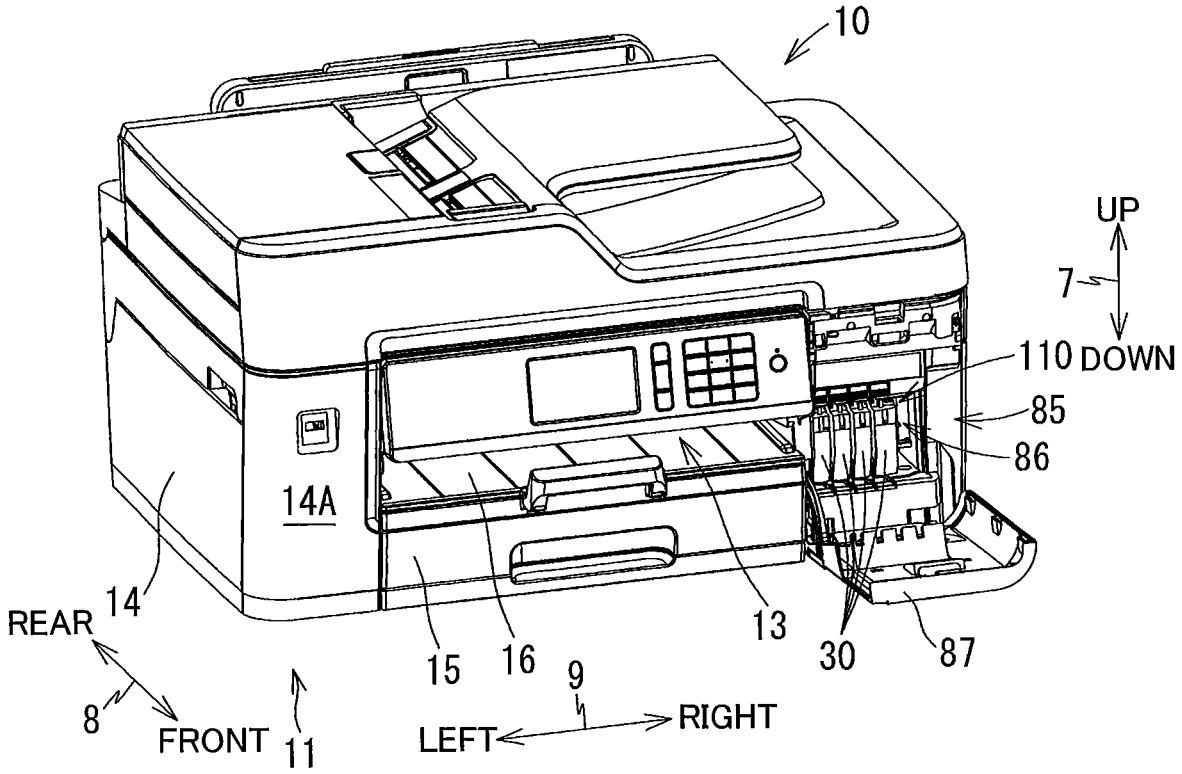
FIG. 1B is a perspective view of the multifunction peripheral according to the embodiment, in which the cover is at an open position.

As illustrated in FIGS. 1A and 1B, the multifunction peripheral 10 (as an example of "a liquid supplying system") has a substantially rectangular parallelepiped shape. The multifunction peripheral 10 has a lower portion at which a printer portion 11 is provided. The printer portion 11 is configured to record an image on a sheet of paper 12 (see FIG. 2) based on an inkjet recording method. The multifunction peripheral 10 may also have a facsimile function, a scanning function, and a copying function.

Figure 2:
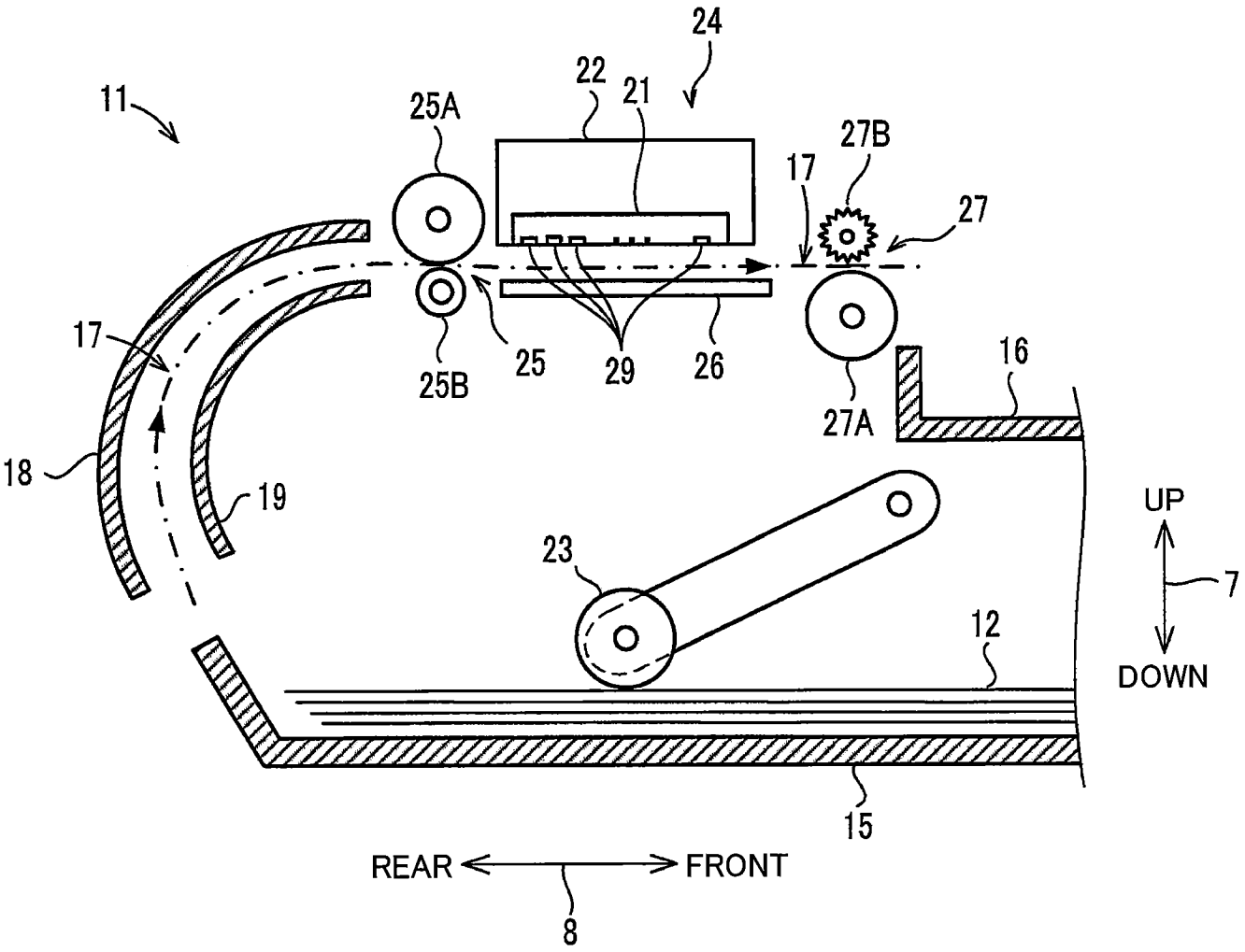
FIG. 2 is a vertical cross-sectional view of schematically illustrating an internal structure of a printer portion in the multifunction peripheral according to the embodiment.

The printer portion 11 includes a casing 14 having a generally rectangular parallelepiped shape. As illustrated in FIG. 2, within the casing 14 provided are a feed tray 15, a discharge tray 16, a feed roller 23, a conveying roller pair 25, a recording portion 24, a discharge roller pair 27, and a platen 26. The printer portion 10 and an ink cartridge 30 (to be described later) will be referred to as a printing system.

<Feed Tray 15, Discharge Tray 16, Feed Roller 23>

As illustrated in FIGS. 1A, 1B and 2, the casing 14 has a front surface 14A at which the opening 13 is formed. The opening 13 is positioned at a generally center portion of the front surface 14A of the casing 14 in the left-right direction 9. The feed tray 15 is configured to be inserted into and removed from the casing 14 through the opening 13 in the front-rear direction 8 by a user. As illustrated in FIG. 2, the feed tray 15 is configured to support a plurality of sheets 12 in a stacked state. The discharge tray 16 is positioned above the feed tray 15. The discharge tray 16 is configured to support the sheets 12 passing through a portion between the recording portion 24 and the platen 26 and discharged by the discharge roller pair 27. The feed roller 23 is configured to feed each of the sheets 12 supported on the feed tray 15 toward a conveying path 17. The feed roller 23 is configured to be driven by a feed motor (not illustrated).

<Conveying Path 17>

As illustrated in FIG. 2, the conveying path 17 is a space defined mainly by guide members 18, 19, the recording portion 24 and the platen 26. Inside the printer portion 11, the guide members 18 and 19 face each other with a predetermined gap therebetween, and the recording portion 24 and the platen 26 face each other with a predetermined gap therebetween. The conveying path 17 extends upward from a rear end portion of the feed tray 15, while making a U-turn toward the front, and passes through between the recording portion 24 and the platen 26, and reaches the discharge tray 16. A conveying direction of the sheet 12 in the conveying path 17 is indicated by a dashed-dotted arrow in FIG. 2.

<Conveying Roller Pair 25>

As illustrated in FIG. 2, the conveying roller pair 25 is disposed at the conveying path 17 and upstream relative to the recording portion 24 in the conveying direction. The conveying roller pair 25 includes a conveying roller 25A and a pinch roller 25B opposed to each other. The conveying roller 25A is configured to be driven by a conveying motor (not illustrated). The pinch roller 25B is configured to be rotated in accordance with rotations of the conveying roller 25A. When the conveying roller 25A is rotated forward in response to forward rotations of the conveying motor, the sheet 12 is conveyed in the conveying direction (i.e. frontward direction) while being nipped between the conveying roller 25A and the pinch roller 25B.

<Discharge Roller Pair 27>

As illustrated in FIG. 2, the discharge roller pair 27 is disposed at the conveying path 17 at a position downstream of the conveying roller pair 27 and the recording portion 24 in the conveying direction. The discharge roller pair 27 includes a discharge roller 27A and a spur roller 27B opposed to each other. The discharge roller 27A is configured to be driven by the conveying motor (not illustrated). The spur roller 27B is configured to be rotated in accordance with rotations of the discharge roller 27A. When the discharge roller 27A is rotated forward in response to the forward rotation of the conveying motor, the sheet 12 is conveyed in the conveying direction (i.e. frontward direction) while nipped between the discharge roller 27A and the spur roller 27B.

<Recording Portion 24 and Platen 26>

As illustrated in FIG. 2, the recording portion 24 (as an example of "a consumption device") and the platen 26 are positioned at the conveying path 17 at a position between the conveying roller pair 25 and the discharge roller pair 27. Specifically, the recording portion 24 and the platen 26 are positioned downstream of the conveying roller pair 25 and upstream of the discharge roller pair 27 in the conveying direction. The recording portion 24 is arranged to oppose the platen 26 in the up-down direction 7, with the conveying path 17 interposed between the recording portion 24 and the platen 26.

The recording portion 24 includes a carriage 22 and a recording head 21 mounted on the carriage 22. The carriage 22 is reciprocally movable in the left-right direction 9 upon transmission of driving force from a drive motor (not illustrated). The recording head 21 has a lower surface at which a plurality of nozzles 29 are open. Each nozzle 29 is operable in accordance with operation of an oscillation element such as a piezoelectric element, so that the oscillation causes ejection of ink droplet. During lateral movements of the carriage 22, ink droplets are selectively ejected from each nozzle 29 onto the sheet 12 supported on the platen 26 to thus form an inked image on the sheet 12.

Figure 3:
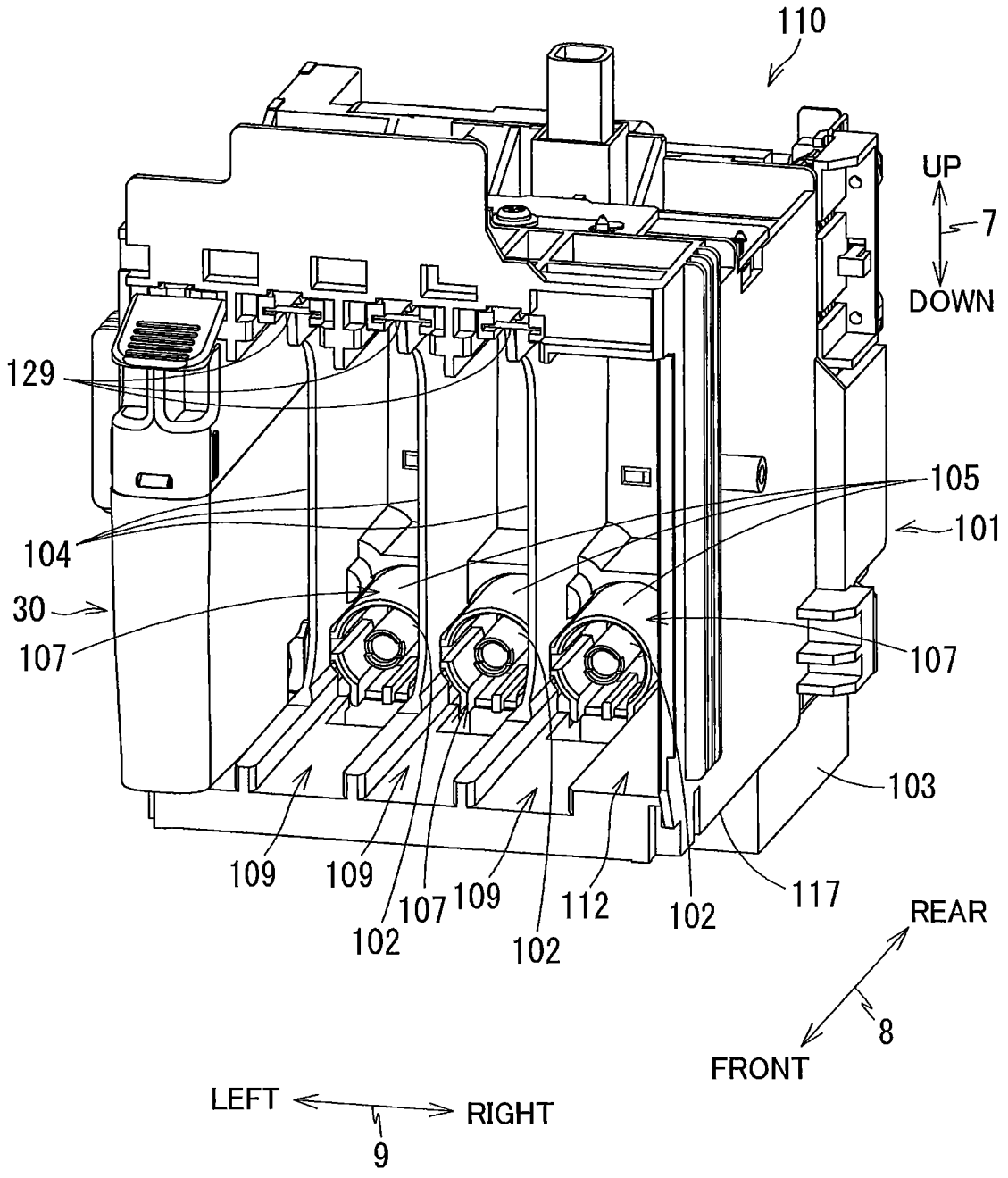
FIG. 3 is a perspective view of a cartridge receiving portion in the multifunction peripheral according to the embodiment as viewed from an opening side thereof.

A bundle of ink tubes (not illustrated) and a flexible flat cable (not illustrated) are connected to the carriage 22. The ink tubes connect the recording head 21 to the cartridge receiving portion 110 (FIG. 3). Specifically, each of the ink tubes is configured to supply ink (as an example of "liquid") stored in a corresponding ink cartridge 30 (as an example of "a cartridge") attached to the cartridge receiving portion 110 to the recording head 21. In the present embodiment, four ink cartridges 30 are attachable to the cartridge receiving portion 110. Accordingly, four ink tubes are provided in one-to-one correspondence with the four ink cartridges 30 so that ink of four colors (black, magenta, cyan, and yellow) stored in the respective four ink cartridges 30 can flow through the corresponding ink tubes 20. These ink tubes are bundled and connected to the recording head 21. The flexible flat cable is configured to electrically connect a control board (not illustrated) to the recording head 21. The control board is configured to control operations of the multifunction peripheral 10.

<Cover 87>

As illustrated in FIG. 1B, an opening 85 is formed in the front surface 14A of the casing 14 at a right end portion thereof in the left-right direction 9. A cover 87 is connected to the casing 14 so as to cover the opening 85. The cover 87 is supported by a lower end portion of the casing 14 so that the cover 87 is pivotally movable about a pivot axis extending in the left-right direction 9 at the lower end portion of the casing 14 between a closed position (a position illustrated in FIG. 1A) for closing the opening 85 and an open position (a position illustrated in FIG. 1B) for exposing the opening 85 to an outside. An accommodation space 86 is formed rearward of the opening 85 and inside the casing 14 for accommodating the cartridge receiving portion 110.

<Cartridge Receiving Portion 110>

Figure 4:
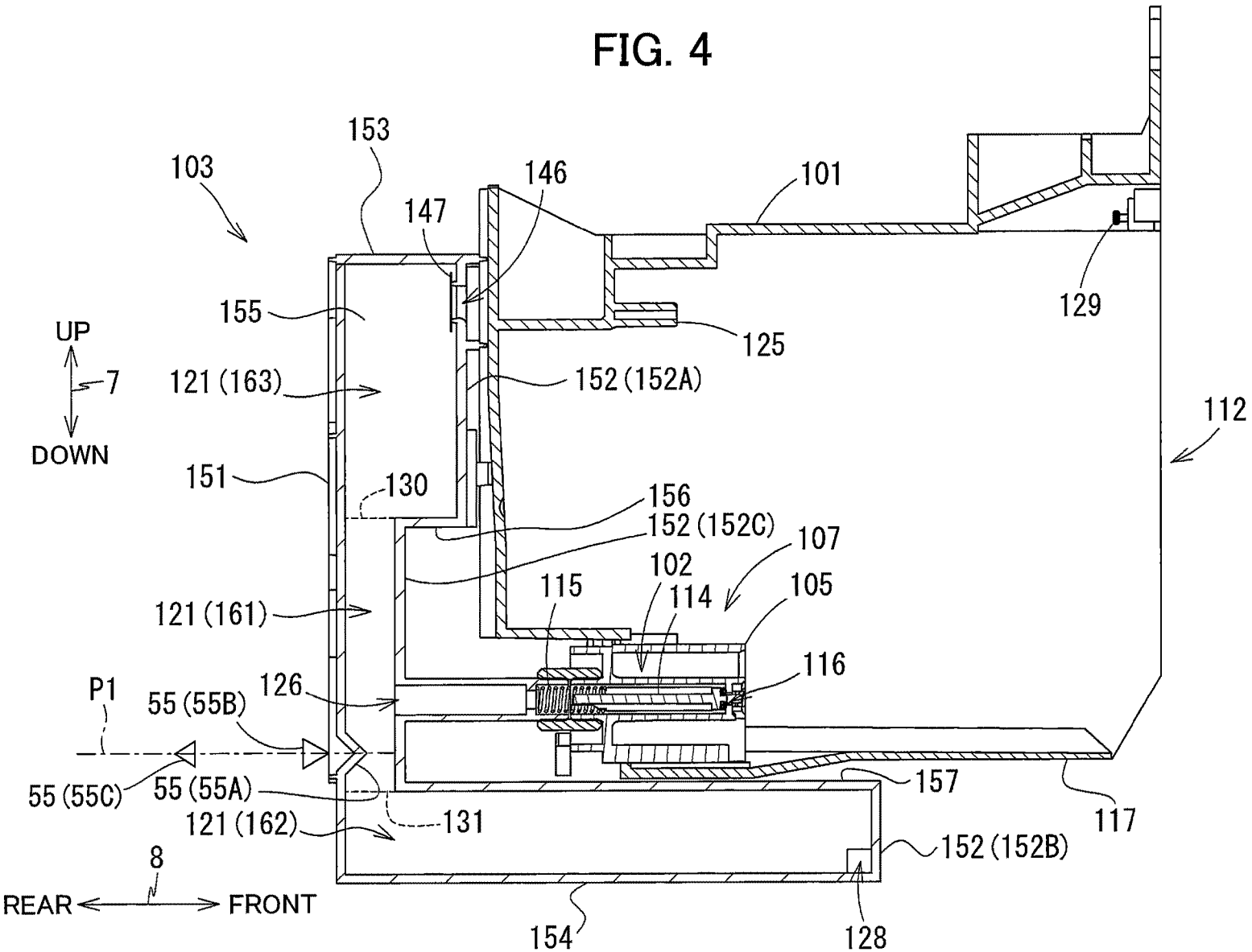
FIG. 4 is a vertical cross-sectional view of the cartridge receiving portion according to the embodiment.

As illustrated in FIGS. 3 and 4, the cartridge receiving portion 110 includes a cartridge case 101, four rods 125, a locking portion 129, four tanks 103, and four liquid-level sensors 55. Four ink cartridges 30 for the colors of cyan, magenta, yellow, and black can be accommodated in the cartridge receiving portion 110. Hence, four rods 125, four tanks 103, and four liquid-level sensors 55 are provided in the cartridge receiving portion 110 for four ink cartridges 30. In other words, each rod 125, each tank 103, and each liquid-level sensor 55 are provided for one-to-one correspondence with each ink cartridge 30. Incidentally, the ink cartridges 30 to be attached to the cartridge receiving portion 110 may differ in number. Further, FIG. 3 illustrates a state where one ink cartridge 30 is attached to a left end section of the cartridge receiving portion 110, while remaining three cartridges 30 are not attached to the cartridge receiving portion 110. The cartridge receiving portion 110 (the printing portion 11) and the ink cartridge 30 constitute an example of a printing system.

The cartridge case 101 constitutes a housing of the cartridge receiving portion 110. The cartridge case 101 has a box-like shape defining an internal space for accommodating the ink cartridges 30. The case 101 has an opening 112 formed at a front end of the cartridge case 101. The opening 112 allows the internal space of the cartridge case 101 to be exposed to the outside. Further, the opening 112 is exposed to the outside of the multifunction peripheral 10 through the opening 85 of the casing 14 when the cover 87 is at the open position (see FIG. 1A).

The ink cartridges 30 can be inserted rearward into and removed frontward from the cartridge receiving portion 110 in the front-rear direction 8 through the opening 85 of the casing 14 and the opening 112 of the cartridge case 101. As illustrated in FIG. 3, a bottom wall of the cartridge case 101 is formed with four guide grooves 109. Movements of the ink cartridges 30 in the front-rear direction 8 are guided by the guide grooves 109 as lower end portions of the ink cartridges 30 are inserted into the respective guide grooves 109. As illustrated in FIG. 3, the cartridge case 101 has three plates 104 that partition the internal space of the cartridge case 101 into four individual spaces arrayed with each other in the left-right direction 9. Each of the four spaces partitioned by the plates 104 is configured to receive one of the four ink cartridges 30 of different colors.

<Rods 125>

As illustrated in FIG. 4, each rod 125 protrudes frontward from the rear wall of the cartridge case 101. The rod 125 is positioned above a corresponding joint 107 (described later). The rod 125 is configured to be inserted into an air valve chamber 36 (FIG. 6, described later) of the ink cartridge 30 through an air communication opening 96 (FIG. 6, described later) of the ink cartridge 30 in a state where the ink cartridge 30 is attached to the cartridge receiving portion 110.

<Locking Portion 129>

As illustrated in FIGS. 3 and 4, the locking portion 129 is positioned adjacent to a top wall of the cartridge case 101 and adjacent to the opening 112 of the cartridge case 101. The locking portion 129 extends in the left-right direction 9. The locking portion 129 is a bar-like member extending in the left-right direction 9. For example, the locking portion 129 is a solid metal cylinder. The locking portion 129 has a left end fixed to a left end wall of the cartridge case 101 and a right end fixed to a right end wall of the cartridge case 101. The locking portion 129 extends in the left-right direction 9 over the four spaces of the cartridge case 101 in which the four ink cartridges 30 are respectively accommodatable.

Figure 7:
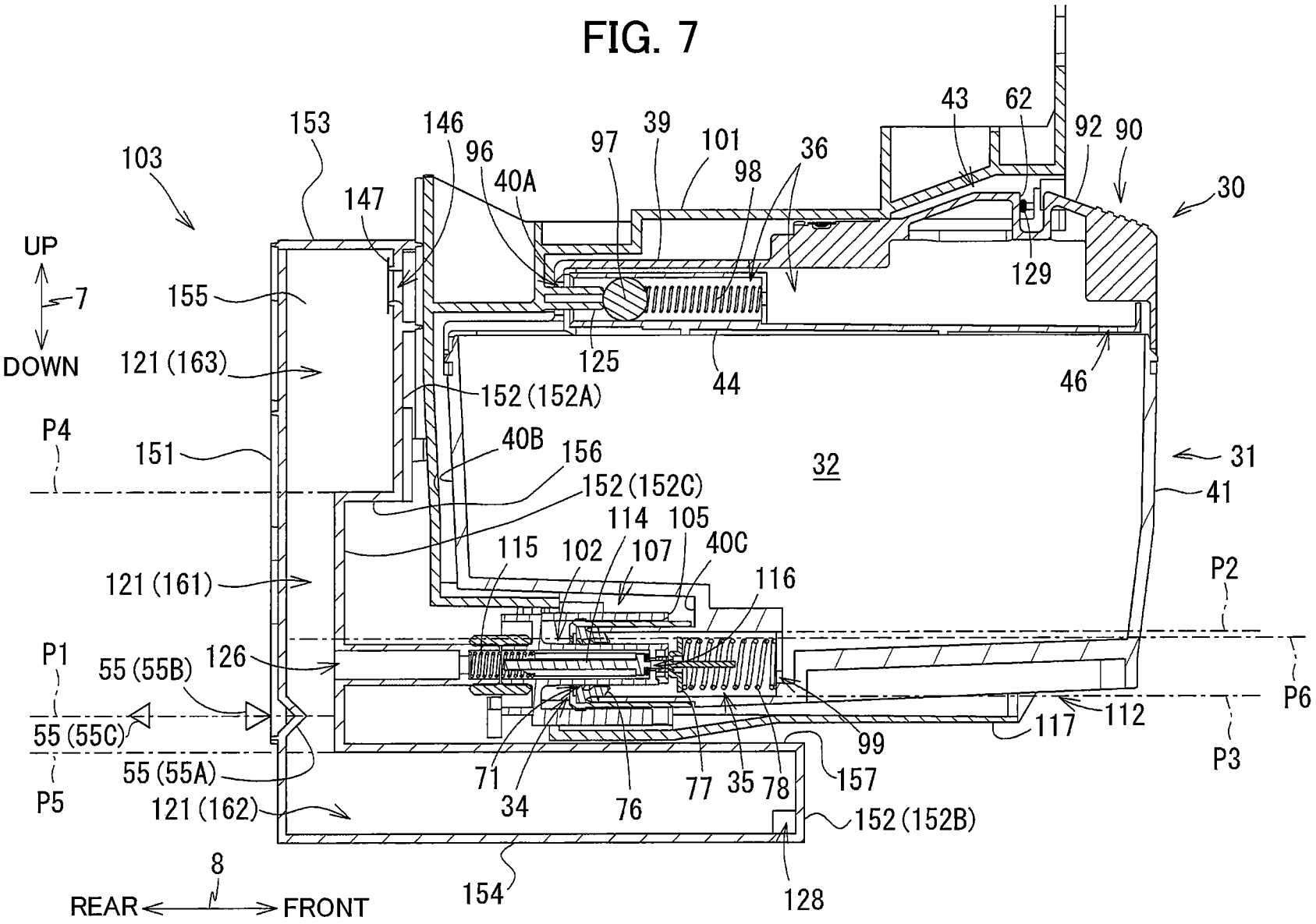
FIG. 7 is a vertical cross-sectional view of the ink cartridge and the cartridge receiving portion to which the ink cartridge is attached according to the embodiment.

The locking portion 129 is configured to retain each of the ink cartridges 30 attached to the cartridge case 101 at an attached position as illustrated in FIG. 7. In a state where the ink cartridges 30 are attached to the cartridge case 101, the ink cartridges 30 are respectively engaged with the locking portion 129. As a result, the locking portion 129 retains each ink cartridge 30 in the cartridge case 101 at the attached position against urging forces of coil springs 78, 98 (described later) that push the ink cartridge 30 frontward.

<Tank 103>

As illustrated in FIG. 4, the tank 103 is provided behind the cartridge case 101.

The tank 103 has a box shape and can accommodate ink internally. The tank 103 includes a storage chamber 121 (as an example of "a second storage chamber") configured to internally store an ink. The tank 103 has a rear wall 151, a front wall 152, an upper wall 153, a lower wall 154, step walls 156 and 157, and a pair of side walls 155. The pair of side walls 155 face each other in the left-right direction 9.

The front wall 152 includes a first wall 152A, a second wall 152B, and a third wall 152C. The first wall 152A extends downward from a front end of the upper wall 153. The second wall 152B is positioned downward and forward farther than the first wall 152A and extends upward from the lower wall 154. The third front wall 152C is positioned between the first wall 152A and the second wall 152B in the up-down direction 7. The third wall 152C is positioned rearward farther than the first wall 152A and the second wall 152B. The step wall 156 connects a lower end of the first wall 152A and an upper end of the third wall 152C. The step wall 157 connects an upper end of the second wall 152B and a lower end of the third wall 152C.

Among the walls constituting the tank 103, at least the rear wall 151 is formed with a part configuring a prism 55A of the liquid level sensor 55 described later. The part has transparency or translucency, so that the part allows light output from a light emitting portion 55B of the liquid level sensor 55 to pass through.

The storage chamber 121 is a space defined by the rear wall 151, the front wall 152, the upper wall 153, the lower wall 154, and the pair of side walls 155. The storage chamber 121 is defined by a first portion 161, a second portion 162, and a third portion 163.

In the storage chamber 121, as indicated in FIG. 4, the first portion 161 is positioned between a dashed line 130 and a dashed line 131 illustrated in FIG. 4. Here, the dashed line 130 is an imaginary line passing through an upper surface of the step wall 157 and extending in the front-rear direction 8. The dashed line 131 is an imaginary line passing through a lower surface of the step wall 157 and extending in the front-rear direction 8. The first portion 161 is defined by the rear wall 151, the third wall 152C, and the pair of side walls 155.

In the storage chamber 121, as indicated in FIG. 4, the second portion 162 is positioned below the dashed line 131 illustrated in FIG. 4. The second portion 162 is defined by the rear wall 151, the second wall 152B, the step wall 157, the lower wall 154, and the pair of side walls 155. The second portion 162 is positioned below the first portion 161.

In the storage chamber 121, as indicated in FIG. 4, the third portion 163 is positioned above the dashed line 130 illustrated in FIG. 4. The third portion 163 is defined by the rear wall 151, the first wall 152A, the step wall 156, the upper wall 153, and the pair of side walls 155. The third portion 163 is positioned above the first portion 161.

A distance between a rear surface of the second wall 152B and a front surface of the rear wall 151 in the front-rear direction 8 is longer than a distance between a rear surface of the third wall 152C and the front surface of the rear wall 151 in the front-rear direction 8. A horizontal cross-sectional area of the second portion 162 at an arbitrary position of the second portion 162 in the up-down direction 7 (area of a virtual surface surrounded by the second wall 152B, the rear wall 151, and the pair of side walls 155 when viewed in the up-down direction 7) is therefore greater than a horizontal cross-sectional area of the first portion 161 at an arbitrary position of the first portion 161 in the up-down direction 7 (area of a virtual surface surrounded by the third wall 152C, the rear wall 151, and the pair of side walls 155 when viewed in the up-down direction 7).

A distance between a rear surface of the first wall 152A and a front surface of the rear wall 151 in the front-rear direction 8 is longer than the distance between the rear surface of the third wall 152C and the front surface of the rear wall 151 in the front-rear direction 8. A horizontal cross-sectional area of the third portion 163 at an arbitrary position of the third portion 163 in the up-down direction 7 (area of a virtual surface surrounded by the first wall 152A, the rear wall 151, and the pair of side walls 155 when viewed in the up-down direction 7) is therefore greater than the horizontal cross-sectional area of the first portion 161.

The distance between the rear surface 151 the second wall 152B and the rear wall 151 is longer than the distance between the front wall 152A and the rear surface of the rear wall 151 in the front-rear direction 8. is longer than the distance between the rear surface of the first wall 152A and the front surface of the rear wall 151 in the front-rear direction 8. The horizontal cross-sectional area of the second portion 162 is therefore greater than the horizontal cross-sectional area that of the third portion 163.

As illustrated in FIG. 4, the prism 55A serving as the liquid level sensor 55 is formed at a predetermined position P1 of the rear wall 151 defining the first portion 161. Therefore, a distance between the third wall 152C and the rear wall 151 at the predetermined position P1 (where the prism 55A is formed) is shorter than a distance between the third wall 152C and the rear wall 151 at positions other than the predetermined position P1. With this configuration, the first portion 161 has a minimum horizontal cross-sectional area at the predetermined position P1. Details of the predetermined position P1 will be described later.

The second portion 162 of the storage chamber 121 is in fluid communication with the ink tube via an outflow port 128 (as an example of "outlet opening"). The outflow port 128 is formed at the frontmost portion of the lower wall 154 defining the second portion 162. The outflow port 128 is positioned below a joint 107. The ink stored in the storage chamber 121 flows out from the outflow port 128. The ink is supplied to the recording head 21 through the ink tube and consumed in the recording head 21.

The first wall 152A is formed with a communication port 146. The communication port 146 extends through the thickness of the first wall 152A. A semipermeable membrane 147 is attached to the communication port, so that the communication port is closed. The semipermeable membrane 147 does not allow the ink from passing through the communication port, but allows air to pass therethrough. Through the communication port 146 and the semipermeable membrane 147, the storage chamber 121 is in air communication with atmosphere. The communication port 146 and the semipermeable membrane 147 configure an example of a second air communicating portion.

<Joints 107>

As illustrated in FIGS. 3 and 4, the joint 107 includes an ink needle 102 and a guide portion 105. The ink needle 102 is made of resin and has a tubular shape. The ink needle 102 protrudes forward from the third wall 152C of the tank 103 to have a protruding end at which an opening 116 is formed. The third wall 152C of the tank 103 is formed with a through-hole 126 (as an example of an "inflow port") for fluid-communicating an interior space of the ink needle 102 and the first portion 161 of the storage chamber 121. Further, the ink needle 102 is arranged at a position corresponding to a position of an ink supplying portion 34 of the ink cartridge 30 attached to the cartridge receiving portion 110 (see FIG. 7).

The guide portion 105 is a hollow cylindrical member provided to surround the ink needle 102. The guide portion 105 protrudes frontward from the tank 103 to have an open end. The ink needle 102 is positioned at a diametrical center of the guide portion 105. The ink supply portion 34 of the ink cartridge 30 is inserted into an interior of the guide portion 105 as the ink cartridge 30 is attached to the cartridge receiving portion 110.

A valve 114 and a coil spring 115 are accommodated in the internal space of the ink needle 102. The valve 114 is movable between an open position and a close position in the front-rear direction 8, and opens the opening 116 at the open position and closes the opening 116 at the close position. The coil spring 115 forwardly urges the valve 114 to close the opening 116. A front-end portion of the valve 114 protrudes farther frontward relative to the opening 116 when the valve 114 is held at the close position.

<Liquid-Level Sensor 55>

Each liquid-level sensor 55 (as an example of a "detecting portion") is configured to detect whether the level of the ink stored in the corresponding storage chamber 121 has reached the predetermined position P1. To this effect, the prism 55A is used that exhibits different reflectivity depending upon whether the ink is in contact with the prism 55A.

As indicated in FIG. 4, the predetermined position P1 is between the dashed-lines 130 and 131 partitioning the first portion 161. Specifically, the predetermined position P1 is the position where the prism 55A is located. That is, the liquid-level sensor 55 is configured to detect the level of the ink stored in the first portion 161. In the embodiment, the predetermined position P1 is below a position at which the through-hole 126 on the first portion 161 is formed.

The liquid level sensor 55 includes the prism 55A, the light emitting portion 55B, and a light receiving portion 55C. A part of the rear wall defining the first portion 161 of the storage chamber at and around the predetermined position P1 configures the prism 55A. The light emitting portion 55B and the light receiving portion 55C are arranged behind the prism 55A to face the same. The light emitting portion 55B is configured to emit light toward the prism 55A. The light receiving portion 55C is configured to receive the light emitted from the light emitting portion 55B and reflected upon the prism 55A. The light receiving portion 55C outputs to the control board an intensity-dependent signal responsive to the received signal.

When the level of the ink stored in the storage chamber 121 is higher than the predetermined position P1, the light emitted from the light emitting portion 55B is directed toward the prism 55A on an optical path of light. At this time, since the prism 55A is immersed in the ink, the light emitted from the light emitting portion 55B passes through the prism 55A and enters into the storage chamber 121. As a result, the light does not enter into the light receiving portion 55C and the light receiving portion 55C outputs a low-level signal to the control board. On the other hand, when the level of the ink stored in the storage chamber 121 is equal to or below the predetermined position P1, the prism 55A is not immersed in the ink, the light emitted from the light emitting portion 55B and directed toward the prism 55A reflects upon the prism 55A, so that the light is received at the light receiving portion 55C. In this case, the light receiving portion 55C outputs a high-level signal to the control board.

A controller mounted on the control board notifies the user that the ink stored in a storage chamber 32 and an ink valve chamber 35 of the ink cartridge 30, which will be described in detail later, cannot be supplied to the tank 103 in response to the high-level signal after receiving the low-level signal from the liquid-level sensor 55. As a notification method, for example, a display may be used which is provided in a multifunction peripheral 10. In other words, the controller determines whether the ink remaining in the storage chamber 32 and the ink valve chamber 35 of the ink cartridge 30 can be supplied to the tank 103 based on the remaining amount of ink in the storage chamber 121 of the tank 103. The controller and the display constitute an example of a notification portion configured to notify a user of whether the liquid stored in the second storage chamber 121 is at the level higher than the predetermined position P1 or the level equal to or lower than the predetermined position P1 in response to the output of the light receiving portion 55C.

<Ink Cartridge 30>

Figure 5:
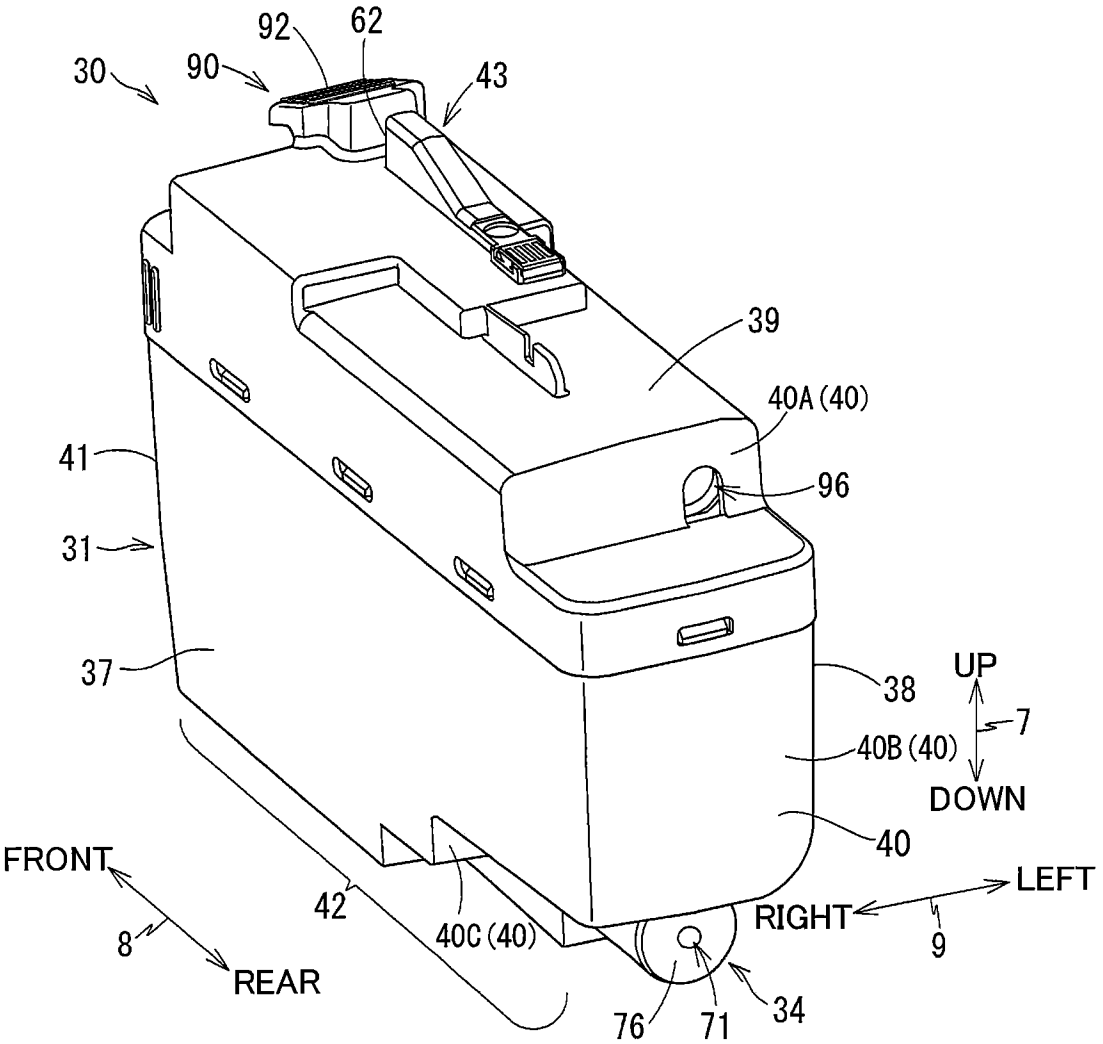
FIG. 5 is a perspective view of an ink cartridge according to the embodiment as viewed from rear side thereof.
Figure 6:
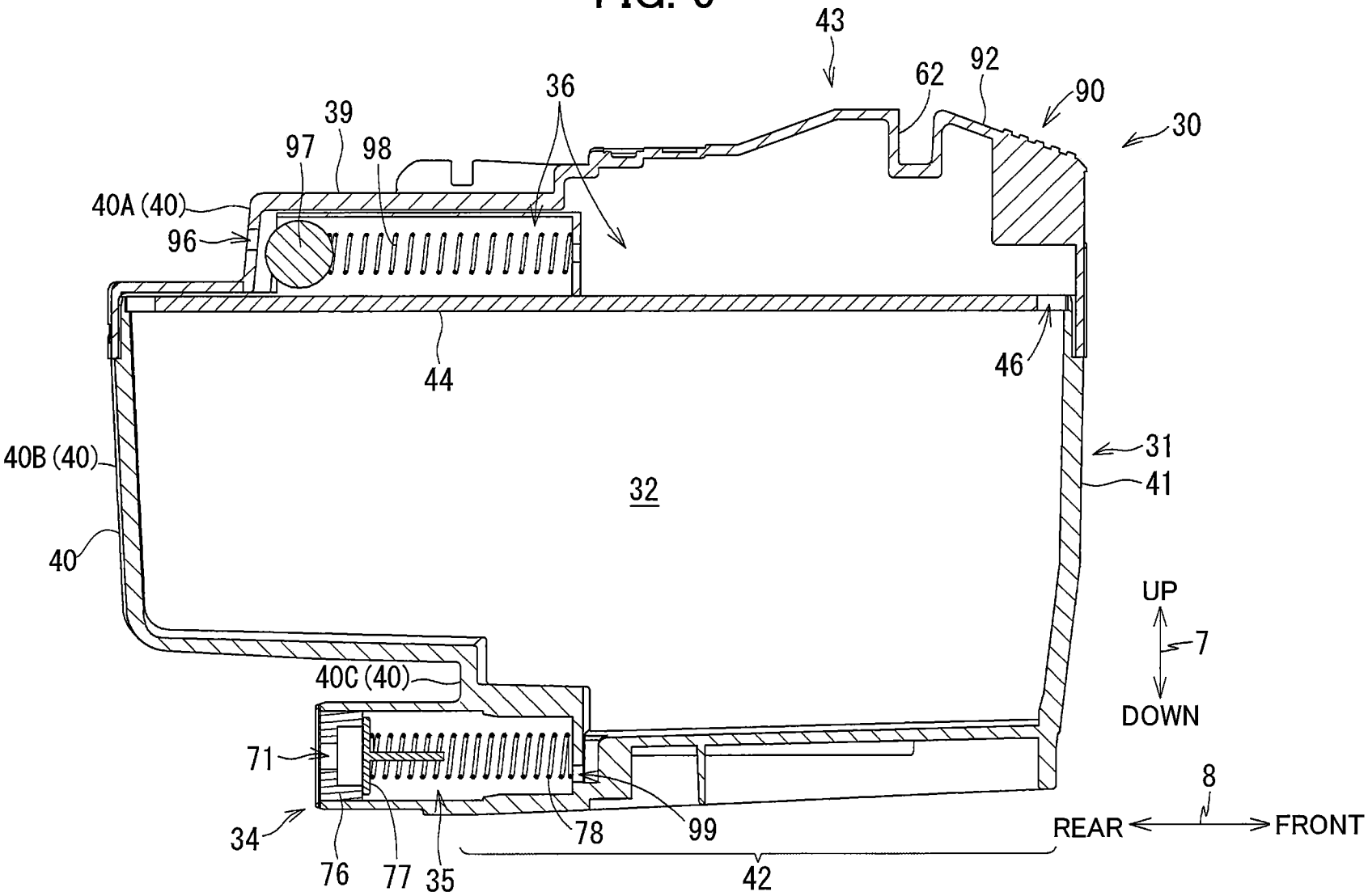
FIG. 6 is a vertical cross-sectional view of the ink cartridge according to the embodiment.

The ink cartridge 30 is a vessel configured to store the ink. As illustrated in FIGS. 5 and 6, the ink cartridge 30 includes a housing 31, the ink supplying portion 34, a projection portion 43, and an operation portion 90. The housing 31 has an overall flattened shape in which a left-right dimension thereof (width) is smaller than a vertical and a front-rear dimensions thereof (height and depth). External shapes of each ink cartridges 30 in which inks in different colors are stored may be identical to one another, or may differ from one another. The housing 31 includes a rear wall 40, a front wall 41, an upper wall 39, a lower wall 42, and side walls 37 and 38.

The rear wall 40 includes a first wall 40A, a second wall 40B, and a third wall 40C. The first wall 40A is positioned forward and upward farther than the second wall 40B. The second wall 40B is positioned rearward and upward farther than the third wall 40C. The third wall 40C is positioned forward and downward farther than the first wall 40A. The first wall 40A is provided with the communication port 96. The third wall 40C is provided with the ink supplying portion 34.

The projecting portion 43 and the operation portion 90 are provided at the upper wall 39. The projecting portion 43 protrudes upward from an outer surface (upper surface) of the upper wall 39 and extends in the front-rear direction 8. The projecting portion 43 has a lock surface 62 facing frontward. The lock surface 62 is positioned upward relative to the upper wall 39. The lock surface 62 is configured to contact the locking portion 129 of the cartridge receiving portion 110 in the state where the ink cartridge 30 is attached to the cartridge receiving portion 110 (see FIG. 7). Contact of the lock surface 62 with the locking portion 129 allows the ink cartridge 30 to be retained at the attached position against the urging force of the coil springs 78, 98.

The operation portion 90 is provided on the upper wall 39 at a position frontward relative to the lock surface 62. The operation portion 90 has an operation surface 92. When the operation surface 92 is pressed downward by the user in the state where the ink cartridge 30 is attached to the cartridge receiving portion 110, the ink cartridge 30 is pivotally moved to move the lock surface 62 downward. As a result, the lock surface 62 is positioned further downward relative to the locking portion 129. The ink cartridge 30 is thus allowed to be removed from the cartridge receiving portion 110.

As illustrated in FIG. 6, the storage chamber 32, the ink valve chamber 35, and the air valve chamber 36 are formed in the internal space of the cartridge casing 31. The storage chamber 32 and the ink valve chamber 35 for storing the ink are an example of a "first storage chamber". The air valve chamber 36 provides communication between the atmosphere and the storage chamber 32.

The storage chamber 32 is a space defined by the rear wall 40, the front wall 41, the lower wall 42, the side walls 37 and 38 (see FIG. 5), and a partition wall 44 partitioning the interior space of the housing 31. The storage chamber 32 and the ink valve chamber 35 are in fluid communication with each other via a through-hole 99. The ink valve chamber 35 is positioned below the storage chamber 32.

The storage chamber 32 and the air valve chamber 36 are in communication with via a through-hole 46 formed on the partition wall 44.

The atmosphere valve chamber 36 is an air channel positioned above the storage chamber 32. A labyrinth channel (not illustrated) or a semipermeable membrane (not illustrated) may be provided at the atmosphere valve chamber 36. A valve 97 and a coil spring 98 are accommodated in the air valve chamber 36. The valve 97 is movable between a closed position closing the air communication opening 96 and an open position opening the air communication opening 96. The coil spring 98 urges the valve 97 toward the closed position, i.e., rearward to close the air communication opening 96. The air valve chamber 36, the valve 97 and the air communication opening 96 are an example of a "first air communicating portion". The configuration of the first air communicating portion is not limited to the configuration described above. For example, the first air communicating portion may be configured to include a through-hole formed in the front wall 41 or the like in order to communicate the storage chamber 32 with outside of the ink cartridge 30 (i.e. atmosphere).

In a process of attaching the ink cartridge 30 to the cartridge receiving portion 110, the rod 125 (FIG. 7) of the cartridge receiving portion 110 enters into the air valve chamber 36 through the air communication opening 96. The rod 125 inserted into the air valve chamber 36 contacts the valve 97 to move the valve 97 frontward against the urging force of the coil spring 98. The storage chamber 32 thus becomes communicated with the atmosphere by the movement of the vale 97 to the open position. Incidentally, a structure for allowing the storage chamber 32 to communicate with the atmosphere is not limited to the structure of this embodiment. Alternatively, a film may be provided to seal the air communication opening 96, so that the rod 125 may break through the film upon entry into the air communication opening 96.

The ink supply portion 34 protrudes rearward from the third wall 40C. The ink supply portion 34 is a hollow cylindrical in shape. The ink supply portion 34 defines an inner space therein serving as the ink valve chamber 35. A protruding end (rear end) of the ink supply portion 34 is open to the outside of the ink cartridge 30.

The ink valve chamber 35 accommodates therein a seal member 76, a valve 77, and the coil spring 78.

The seal member 76 is provided in a rear end portion of the ink supply portion 34. The seal member 76 is a disc-shaped member formed with an ink supply port 71 at a radially center portion thereof. The ink supply port 71 extends through a thickness of the disc-shaped seal member 76 in the front-rear direction 8. The ink supply port 71 has an inner diameter slightly smaller than an outer diameter of the ink needle 102. The valve 77 is configured to move in the front-rear direction 8 between a closed position and an open position. In the closed position, the valve 77 is in abutment with the seal member 76 for closing the ink supply port 71, while in the open position, the valve 77 is moved away from the seal member 76 for opening the ink supply port 71. The coil spring 78 urges the valve 77 in a direction toward the closed position, i.e., rearward, to close the ink supply port 71.

In the process of attaching the ink cartridge 30 to the cartridge receiving portion 110, the ink needle 102 of the cartridge receiving portion 110 enters into the ink valve chamber 35 through the ink supply port 71. At this time, an outer peripheral surface of the ink needle 102 provides liquid-tight contact with an inner peripheral surface of the ink supply port 71 while elastically deforming the seal member 76. As the tip end (front end) of the ink needle 102 passes through the seal member 76 and advances further into the ink valve chamber 35, the tip end of the ink needle 102 abuts on the valve 77, thereby moving the valve 77 to the open position against the urging force of the coil spring 78. While the tip end of the ink needle 102 abuts on the valve 77, the valve 77 abuts on the valve 114 in the ink needle 102 and pushes the valve 114 rearward against the urging force of the coil spring 115 to open the opening 116 of the ink needle 102.

As a result, as illustrated in FIG. 7, the ink supply port 71 and the opening 116 are opened respectively, thereby allowing communication of ink between the ink valve chamber 35 of the ink supply portion 34 and the internal space of the ink needle 102. Consequently, the ink stored in the storage chamber 32 and the storage chamber 33 of the ink cartridge 30 can be supplied to the storage chamber 121 of the tank 103 due to hydraulic head difference through the ink supply portion 34 and the joint 107 connected to each other.

While the ink cartridge 30 is attached to the cartridge receiving portion 110, in the vertical direction, an upper end of the ink valve chamber 35 is positioned below an upper end of the first portion 161 of the storage chamber 121. In other words, as indicated in FIG. 7, in the vertical direction, a position P2 where the upper end of the ink valve chamber 35 is positioned below a position P4 where the upper end of the first portion 161 of the storage chamber 121. A lower end of the ink valve chamber 35 is positioned above a lower end of the first portion 161. In other words, a position P3 where the lower end of the ink valve chamber 35 is positioned above a position P5 where the lower end of the storage chamber 121. That is, in this state, a part of the first portion 161 and a whole of the ink valve chamber 35 are identical in position to each other in the up-down direction 7. In other words, the part of the first portion 161 and the whole of the ink valve chamber 35 overlap as viewed in the front-rear direction 8.

A posture of the multifunction machine 10 illustrated in FIGS. 1A and 1B represents the operable posture. In the operable posture, the multifunction machine 10 performs various operations based on the control of the controller, such as recording an image. A printing process as an example of various operations will be described herein with reference to the flowchart in FIG. 10. In the printing process, the ink stored in the storage chamber 32 of the ink cartridge 30 and the storage chamber 121 of the tank is consumed as images are recorded on the paper 12.

While the ink cartridge 30 is attached to the cartridge receiving portion 110, the ink can circulate between the storage chamber 32 of the ink cartridge 30 and the storage chamber 121 of the tank 103. Therefore, the ink stored in the storage chamber 32 can flow into the storage chamber 121 due to a hydraulic head difference, so that a liquid level of the storage chamber 121 is equal to a liquid level of the storage chamber 32.

In this state, when the printing process starts (S10), the ink stored in the storage chambers 32 and 121 outflows from the outflow port 128 to the recording head 21. At this time, an amount of the ink outflowing per unit time from the storage chamber 32 and an amount of the ink outflowing per the unit time from the storage chamber 121 are not always equal to each other. Therefore, one of the liquid levels of the storage chambers 32 and 121 might lower temporarily than the other one of the liquid levels of the storage chambers 32 and 121. As time passes by, however, a hydraulic head difference equals a height of the liquid level of the storage chamber 32 and a height of the liquid level of the storage chamber 121 to each other.

When the storage chambers 32 and 121 fully store the ink (e.g., the liquid levels are positioned above the position P4 in FIG. 7), the light receiving portion 55C of the liquid level sensor 55 outputs a low-level signal to the controller. As the controller receives the low-level signal, the controller determines that the liquid levels of the ink stored in the tank 103 are higher than the predetermined position P1 (S20: No). The determination will be executed always or at predetermined intervals until the image is fully recorded on the paper 12 (S30: No, S20). As the image is fully recorded on the paper 12 (S30: Yes), the printing process ends.

Figure 10:
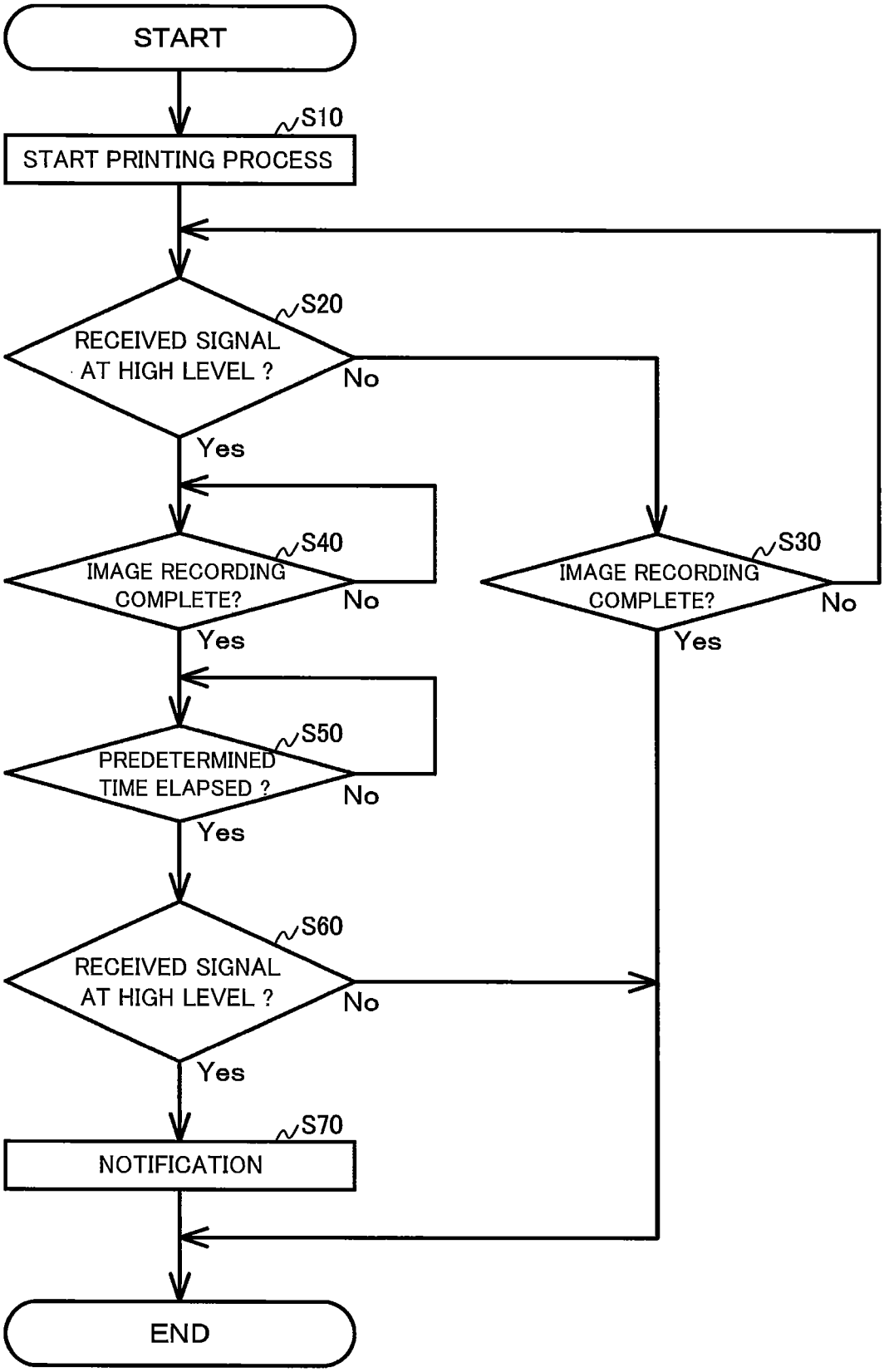
FIG. 10 is a flowchart for explaining printing processes.

Each time the printing process is executed, that is, as the processing shown in FIG. 10 us repeated, the ink is consumed. As the ink is consumed, the liquid levels of the storage chambers 32 and 121 lower. As the liquid levels lower, both the liquid levels just below the boundary position of the between the first portion 161 and the third portion 163 of the storage chamber 121. That is, the liquid levels of the storage chambers 32 and 121 is positioned between the upper end and the lower end of the first portion 161 in the up-down direction 7. The liquid levels at this time are illustrated by an alternate long and short dash line in FIG. 7 as a position P6. The position P6 is positioned between the position P4 and the position P5 in the up-down direction 7.

Next, the printing process is performed in a state where the liquid levels of the storage chambers 32 and 121 has reached the position P6 in the up-down direction 7 will be described in detail.

When the printing process is performed while the liquid levels are at the position P6, the ink stored in the storage chambers 32 and 121 is consumed, so that the liquid level of the first portion 161 of the storage chamber 121 lowers. In this state, when the liquid level reaches the predetermined position P1, the light receiving portion 55C of the liquid level sensor 55 outputs a high-level signal to the controller.

As the controller receives the high-level signal, the controller determines that the liquid level of the storage chamber 121 is at a height equal to or below the predetermined position P1 (S20: Yes). In this state, after the image is fully recorded on the paper 12 (S40: Yes), the controller waits until a predetermined time passes by (S50). Here, the predetermined time is stored in the storage section (not shown) of the controller, and an average time required for equalizing the liquid levels of the storage chamber 32 and 121 in one processing process due to the hydraulic head difference. The predetermined time is set in accordance with, for example, an average amount of consumption of the ink in one printing process, and a speed of circulation of the ink between the storage chambers 32 and 121 based on a hydraulic head difference.

After the predetermined time has passed (S50: Yes), the controller again refers to a signal received from the liquid level sensor 55 (S60). When the received signal is at a high level, the controller determines that the liquid level is at a height equal to or below the predetermined position P1 as in the determination at S20 (S60: Yes). At this time, the controller notifies that an amount of the ink stored in the storage chamber 32 of the ink cartridge 30 has reached the predetermined amount. Further, the controller notifies that, for example, the amount of the ink remaining and stored in the storage chamber 32 is not enough, and therefore the ink stored in the storage chamber 32 cannot be supplied to the tank 103 (S70). That is, in this embodiment, the ink remaining in the cartridge 30 is assumed to be an amount of ink corresponding to the amount ink in the tank 103. And, based on an amount of the ink remaining and stored in the storage chamber 121 of the tank 103, the controller determines whether the ink stored in the storage chamber 32 and the ink valve chamber 35 of the ink cartridge 30 can be supplied to the tank 103. After that, the printing process ends. The result of the determination indicates that, the liquid level of the storage chamber 121 has reached a height equal to or below the predetermined position P1 as the ink is consumed. That is, the result indicates that, even though a hydraulic head difference has caused the ink to circulate between the storage chambers 32 and 121 until the predetermined time has passed, the liquid level of the storage chamber 121 has not returned to a height higher than the predetermined position P1.

On the other hand, when the received signal is at a low level, the controller determines that the liquid level is higher than the predetermined position P1 unlike the determination at S20 (S60: No). In this case, the controller does not provide a notification described above, and the printing process simply ends. The result of the determination indicates that the liquid level of the storage chamber 121 has reached a height equal to or below the predetermined position P1 as the ink is consumed. However, a hydraulic head difference has caused the ink to inflow from the storage chamber 32 until the predetermined time has passed, so that the liquid level of the storage chamber 121 has returned to a height higher than the predetermined position P1.

The predetermined position P1 is at a height identical to a height in the first portion 161 having the smaller horizontal cross-sectional area in the storage chamber 121 than that of the second portion 162 and the third portion 163. More specifically, in this embodiment, the predetermined position P1 is the position where the prism 55A of the liquid level sensor 55 is located, so that the first portion 161 has the minimum horizontal cross-sectional area at the predetermined position P1. Since the first portion 161 has the smaller horizontal cross-sectional area, the liquid level of the storage chamber 121 tends to move up and down in a case where the liquid level is positioned between the position P4 and the position P5 as compared with the liquid level being present within the second portion 162 and the third portion 163. Even when the liquid level of the storage chamber 121 lowers temporarily below the predetermined position P1 in step S20, the liquid level therefore immediately moves upward above the predetermined position P1 by inflows of the ink from the storage chamber 32 due to a hydraulic head difference. That is, even when the predetermined time is set shorter, the liquid level of the storage chamber 121 would be highly likely to return to a height higher than the predetermined position P1 until the predetermined time passes by (S50) by inflows of the ink from the storage chamber 32 due to a hydraulic head difference.

Effects of the Embodiment

According to the embodiment, the liquid level sensor 55 detects a liquid level at the predetermined position P1 which is at a height identical to a height in the first portion 161 having the smaller horizontal cross-sectional area in the storage chamber 121 than that of the second portion 162 and the third portion 163. Since the first portion 161 has the smaller horizontal cross-sectional area, the liquid level of the storage chamber 121 tends to move up and down in a case where the liquid level is present within the first portion 161. That is, even when the ink outflows from the storage chamber 121 via the outflow port 128, the liquid level immediately moves upward above the predetermined position P1 by inflows of the ink from the storage chamber (the storage chamber 32 and the ink valve chamber 35) of the ink cartridge 30 via the through-hole 126 due to a hydraulic head difference. Here, in a conventional configuration, even when ink remains in a storage chamber of an ink cartridge to exceed a predetermined amount, there is possibility that the ink stored in the storage chamber of the ink cartridge is erroneously detected as being reached the predetermined amount. On the other hand, according to the configuration according to the present disclosure, since the liquid level of the storage chamber 121 immediately moves upward, possibility of such erroneous detection is not likely to occur.

According to the embodiment, the tank 103 has the third portion 163 above the first portion 161. The third portion 163 has the horizontal cross-sectional area greater than the horizontal cross-sectional area of the first portion 161 at an arbitrary position of the third portion 163 in the up-down direction 7. According to this configuration, when the liquid level is present within the third portion 163, the liquid level does not lower easily.

According to the embodiment, when the ink outflows from the storage chamber of the ink cartridge 30, the ink inflows directly to the first portion 161 of the storage chamber 121 via the through hole 126. The liquid level of the first portion 161 therefore moves easily.

If the predetermined position P1 is located higher than the through-hole 126, even if ink that can be supplied to the ink cartridge remains, there is a possibility that it may erroneously be detected that it is less than the predetermined amount. On the other hand, according to the embodiment, the predetermined position P1 is lower than the through hole 126. According to this configuration, it can therefore be detected that the storage chamber of the ink cartridge 30 does not fully store the ink, and thus the storage chamber 121 cannot supply the ink.

According to the embodiment, even after the storage chamber of the ink cartridge 30 has fully supplied the ink, the storage chamber 121 of the tank 103 cannot supply the ink, and no ink inflows from the storage chamber of the ink cartridge 30 to the storage chamber 121 of the tank 103, the second portion 162 of the storage chamber 121 still stores a large amount of the ink. The ink remaining in the second portion 162 can thus be supplied to the recording portion 24.

Compared with a case when an arm configured to move in the storage chamber 121 is arranged in the storage chamber 121, for example, a case when the prism 55A is arranged in the storage chamber 121 requires a less space. The prism 55A can therefore be easily arranged at the predetermined position P1 on the first portion 161 having the smaller horizontal cross-sectional area.

According to the embodiment, the first portion 161 has the minimum horizontal cross-sectional area at the predetermined position P1. The liquid level therefore further easily moves around the predetermined position P1.

First and Second Modification

Figure 8A:
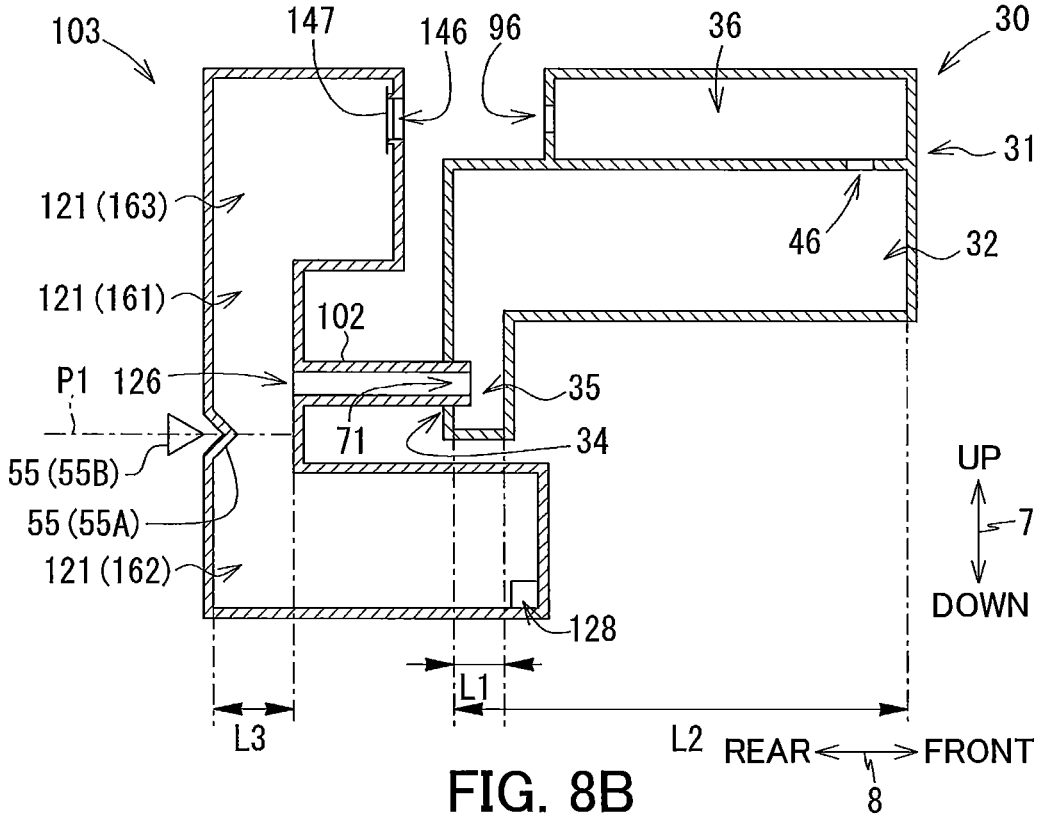
FIG. 8A is a vertical cross-sectional view of a schematically illustrated ink cartridge and a cartridge receiving portion to which the ink cartridge is attached according to a first modification.

The ink cartridge 30 and the tank 103 may be arranged as illustrated in FIG. 8A. In the configuration illustrated in FIG. 8A, a length L1 of the ink valve chamber 35 in the front-rear direction 8 is shorter than a length L2 of the storage chamber 32 in the front-rear direction 8. In the configuration illustrated in FIG. 8A, a length of the ink valve chamber 35 in the left-right direction 9 is also shorter than a length of the storage chamber 32 in the left-right direction 9. In the configuration illustrated in FIG. 8A, a horizontal cross-sectional area of the ink valve chamber 35 is therefore smaller than a horizontal cross-sectional area of the storage chamber 32. In the configuration illustrated in FIG. 8, the storage chamber 32 is an example of a fourth portion. The ink valve chamber 35 is an example of a fifth portion.

In the configuration illustrated in FIG. 8A, the length L1 of the ink valve chamber 35 in the front-rear direction 8 is shorter than a length L3 of the first portion 161 of the storage chamber 121 of the tank 103 in the front-rear direction 8. The length of the ink valve chamber 35 in the left-right direction 9 is also shorter than a length of the first portion 161 in the left-right direction 9. A horizontal cross-sectional area of the first portion 161 is therefore greater than the horizontal cross-sectional area of the ink valve chamber 35.

Figure 8B:
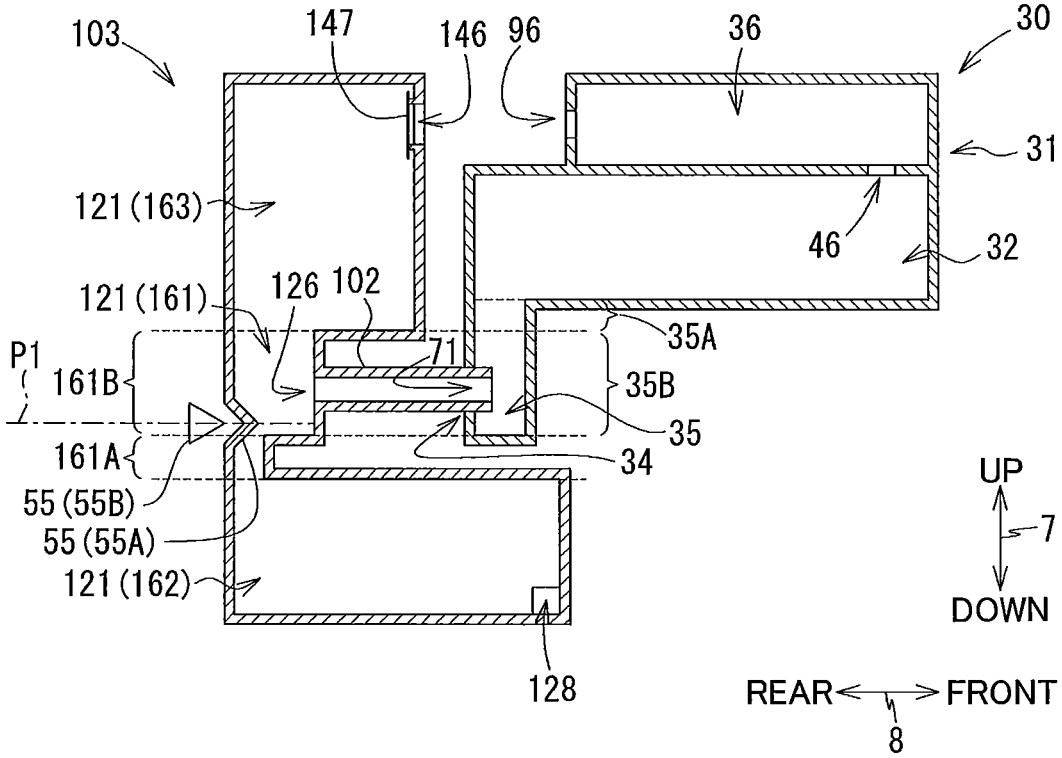
FIG. 8B is a vertical cross-sectional view of a schematically illustrated ink cartridge and a cartridge receiving portion to which the ink cartridge is attached according to a second modification.

In the configuration illustrated in FIG. 8A, similar to the embodiment described above, while the ink cartridge 30 is attached to the cartridge receiving portion 110, a part of the first portion 161 and a whole of the ink valve chamber 35 are identical in position to each other in the up-down direction 7. However, at least a part of the first portion 161 and at least a part of the ink valve chamber 35 may be identical in position to each other in the up-down direction 7. For example, as illustrated in FIG. 8B, a portion 161B of the first portion 161, excluding a lower end portion 161A, and a portion 35B of the ink valve chamber 35, excluding an upper end portion 35A, may be identical in position to each other in the up-down direction 7. That is, a part of the first portion 161 and a part of the ink valve chamber 35 may be identical in position to each other in the up-down direction 7.

In the configuration illustrated in FIG. 8A, at all positions in the up-down direction 7, the horizontal cross-sectional area of the first portion 161 is greater than the horizontal cross-sectional area of the ink valve chamber 35. However, the horizontal cross-sectional area of the first portion 161 may be at least greater than the horizontal cross-sectional area of the ink valve chamber 35 at the position where the first portion 161 and the ink valve chamber 35 are identical in position to each other in the up-down direction 7. For example, as illustrated in FIG. 8B, a horizontal cross-sectional area of the lower end portion 161A of the first portion 161 (at a position different from the position of the ink valve chamber 35 in the up-down direction 7) may be smaller than the horizontal cross-sectional area of the ink valve chamber 35.

According to these modifications, at the position where the first portion 161 and the ink valve chamber 35 are identical in position to each other in the up-down direction 7, the horizontal cross-sectional area of the first portion 161 is greater than the horizontal cross-sectional area of the ink valve chamber 35. While the liquid levels are respectively present within the first portion 161 and the ink valve chamber 35, when the ink is supplied to the recording portion 24, the liquid level of the ink valve chamber 35 therefore easily lowers below the liquid level of the first portion 161. As a result, after the liquid level of the storage chamber 121 lowers below the through-hole 126, the ink is prevented from inflowing from the ink valve chamber 35, via the through-hole 126, to the storage chamber 121.

Other Modifications

In the embodiment described above, the through-hole 126 is formed on the third wall 152C of the tank 103. The through-hole 126 and the first portion 161 are thus in communication with each other. However, the through-hole 126 may be formed on another wall (e.g., the first wall 152A and the step wall 157) than the third wall 152C. The through-hole 126 and another portion than the first portion 161 (the second portion 162 and the third portion 163) may be in communication with each other. That is, the joint 107 may protrude from another wall than the third wall 152C.

In the embodiment described above, the predetermined position P1 is positioned below the through-hole 126. However, the predetermined position P1 and the through-hole 126 may be identical in position in the up-down direction 7. The predetermined position P1 may be positioned above the through-hole 126.

In the embodiment described above, the horizontal cross-sectional area of the second portion 162 is greater than the horizontal cross-sectional area of the third portion 163. However, the horizontal cross-sectional area of the second portion 162 may be equal to or smaller than the horizontal cross-sectional area of the third portion 163.

In the embodiment described above, the first portion 161 has the minimum horizontal cross-sectional area at the predetermined position P1. However, the first portion 161 may have a minimum horizontal cross-sectional area at another position than the predetermined position P1. For example, FIG. 8B illustrates a configuration. In the configuration, the first portion 161 has a minimum horizontal cross-sectional area at the lower end portion 161A of the first portion 161. The lower end portion 161A is lower than the predetermined position P1. The first portion 161 may have a constant horizontal cross-sectional area regardless of a position in the up-down direction 7.

Figure 9B:
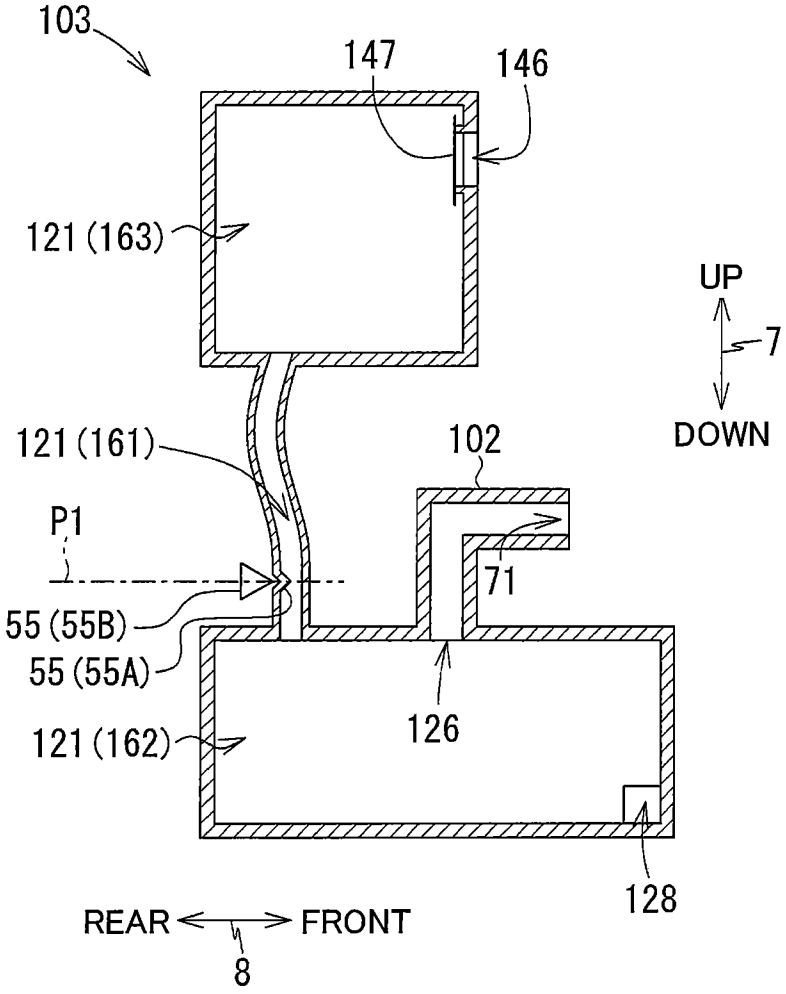
FIG. 9B is a vertical cross-sectional view of schematically illustrated tank according to another modification.
Figure 9A:
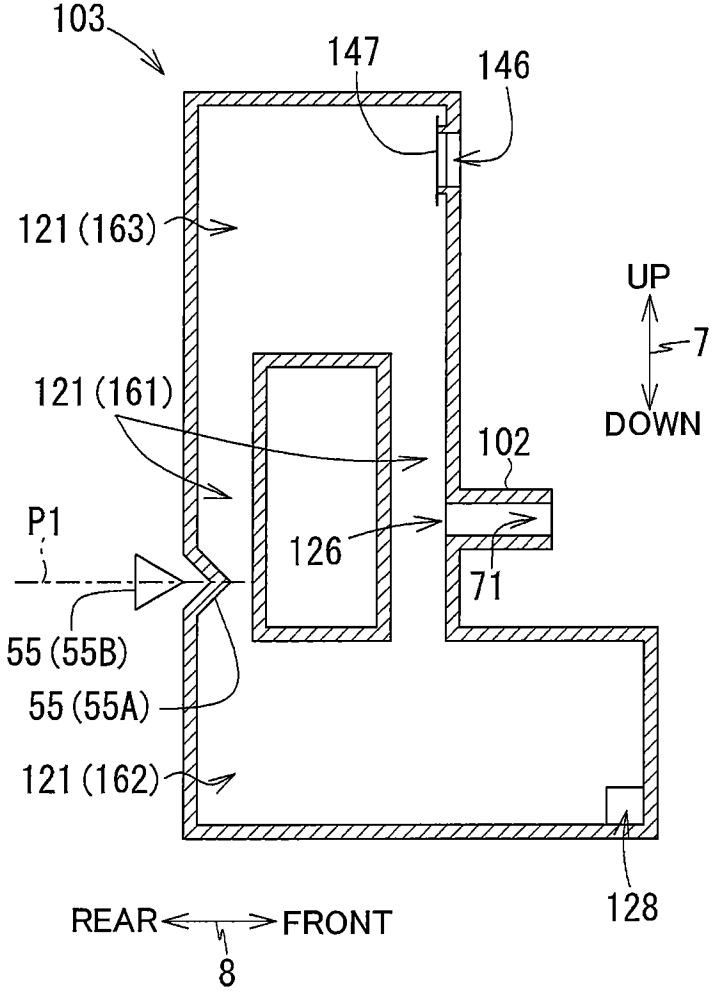
FIG. 9A is a vertical cross-sectional view of schematically illustrated tank according to another modification.

A shape of the tank 103 is not limited to the shapes illustrated in FIGS. 4, 7, and 8. For example, as illustrated in FIG. 9A, the storage chamber 121 may be provided with the two first portions 161. In the configuration illustrated in FIG. 9A, a total of horizontal cross-sectional areas of the two first portions 161 is greater than a horizontal cross-sectional area of the ink valve chamber 35. For example, as illustrated in FIG. 9B, at least a part of the first portion 161 of the storage chamber 121 may be formed of a tube.

In the embodiment described above, the liquid level sensor 55 uses the prism 55A. However, the liquid level sensor 55 may be adopted with another known configuration. For example, an arm having a detection-target portion may be provided in the storage chamber 121. The arm may be configured to rotate when a level of an ink is equal to or below the predetermined position P1. As the arm rotates, the detection-target portion may change in position. Depending on whether an optical sensor detects the detection-target portion of the arm, whether the level of the ink is equal to or below the predetermined position P1 can be determined.

Electrode bars may be adopted as the liquid level sensor 55. The electrode bars are inserted into the storage chamber 121. In this case, the storage chamber 121 is arranged with the two electrode bars. The two electrode bars are mounted on a substrate (not illustrated). The two electrode bars respectively have lower ends. One of the lower ends is positioned slightly above the predetermined position P1. The other of the lower ends of the two electrode bars is positioned below the predetermined position P1. Based on whether a current flows between the two electrode bars via an ink, whether the level of the ink stored in the storage chamber 121 is at or below the predetermined position P1 is detected.

In the embodiment described above, the communication port 146 is formed on the first wall 152A. However, the communication port 146 may be formed on another wall than the first wall 152A. For example, the communication port 146 may be formed on the upper wall 153.

A shape of the ink cartridge 30 is not limited to the shapes illustrated in FIGS. 5, 6, and 8. For example, the ink cartridge 30 has a simple rectangular parallelepiped shape. An internal configuration of the ink cartridge 30 is also not limited to the configurations illustrated in the drawings, such as FIGS. 6 and 8. For example, the interior space of the housing 31 may not be formed with the air valve chamber 36. The storage chamber 32 may be in communication with atmosphere via a through-hole formed on the upper wall 39, for example.

In the embodiment described above, the ink cartridge 30 is inserted into or removed from the cartridge receiving portion 110 in a horizontal direction. However, the insertion-removal direction of the ink cartridge 30 is not limited to the horizontal direction. For example, the ink cartridge 30 may be inserted into or removed from the cartridge receiving portion 110 in a vertical direction.

In the embodiment described above, the ink is described as an example of a liquid. The recording portion 24 is described as an example of a consumption device. However, the present invention is not limited to the examples. For example, the present invention is applied to a device configured to use a roller to apply a pretreatment liquid onto a sheet of paper prior to applying an ink during printing the pretreatment liquid represents an example of the liquid, while the roller represents an example of the consumption device.

While the description has been made in detail with reference to the embodiments thereof, it would be apparent to those skilled in the art that many modifications and variations may be made therein without departing from the spirit of the disclosure.

What is claimed is:

1. A liquid supplying system comprising:

a cartridge comprising:

a first storage chamber configured to store liquid therein; and a first air communicating portion allowing the first storage chamber to communicate with an atmosphere;

a tank to which the cartridge is connectable, the tank comprising:

a second storage chamber configured to store the liquid therein;

an inlet opening through which the liquid stored in the first storage chamber of the cartridge connected to the tank is flowed into the second storage chamber;

an outlet opening through which the liquid stored in the second storage chamber is discharged; and a second air communicating portion allowing the second storage chamber to be communicated with the atmosphere; and a detecting portion configured to detect that the liquid stored in the second storage chamber becomes a predetermined level in a vertical direction, wherein the second storage chamber comprises:

a first portion;

a second portion positioned below the first portion and having a horizontal cross-sectional area greater than a horizontal cross-sectional area of the first portion; and a third portion positioned above the first portion and having a horizontal cross-sectional area greater than a horizontal cross-sectional area of the first portion, wherein the outlet opening is in communication with the second portion, and wherein the detecting portion is configured to detect the level of liquid stored in the first portion.

2. The liquid supplying system according to claim 1, wherein the inlet opening is in communication with the first portion.

3. The liquid supplying system according to claim 1, wherein the predetermined level is below the inlet opening.

4. The liquid supplying system according to claim 1, wherein the second portion has a horizontal cross-sectional area greater than a horizontal cross-sectional area of the third portion.

5. The liquid supplying system according to claim 1, wherein the detecting portion comprises:

a prism, a vertical position of the prism is in coincidence with the predetermined level in the second storage chamber; and a light emitting portion configured to emit light toward the prism.

6. The liquid supplying system according to claim 5, further comprising a light receiving portion configured to receive light emitted from the light emitting portion and reflected from the prism when the liquid stored in the second storage chamber is at a level equal to or lower than the predetermined level, wherein when the liquid stored in the second storage chamber is at a level higher than the predetermined level, the light emitted from the light emitting portion passes through the prism and is not received at the light receiving portion, the light receiving portion producing an output dependent upon whether the light is received or not.

7. The liquid supplying system according to claim 6, further comprising a notification portion configured to notify a user of whether the liquid stored in the second storage chamber is at the level higher than the predetermined level or the level equal to or lower than the predetermined level in response to the output of the light receiving portion.

8. The liquid supplying system according to claim 1, wherein the first storage chamber comprises:

a fourth portion; and a fifth portion positioned below the fourth portion and having a horizontal cross-sectional area smaller than a horizontal cross-sectional area of the fourth portion, wherein the inlet opening permits the liquid to flow from the fifth portion into the second storage chamber, and wherein the first portion has a portion positioned at a level same as a level of a portion of the fifth portion in the vertical direction, the portion of the first portion having a horizontal cross-sectional area greater than a horizontal cross-sectional area of the portion of the fifth portion.

9. The liquid supplying system according to claim 1, wherein a horizontal cross-sectional area of the first portion at a vertical height equal to the predetermined level is minimum with respect to the first portion.

10. A printing system comprising:

an ink cartridge comprising:

a first storage chamber configured to store ink therein; and a first air communicating portion allowing the first storage chamber to communicate with an atmosphere;

a tank to which the ink cartridge is connectable, the tank comprising:

a second storage chamber configured to store the ink therein;

an inlet opening through which the ink stored in the first storage chamber of the ink cartridge connected to the tank is flowed into the second storage chamber;

an outlet opening through which the ink stored in the second storage chamber is discharged; and a second air communicating portion allowing the second storage chamber to be communicated with the atmosphere; and a detecting portion configured to detect that the ink stored in the second storage chamber becomes a predetermined position in a vertical direction, wherein the second storage chamber comprises:

a first portion;

a second portion positioned below the first portion and having a horizontal cross-sectional area greater than a horizontal cross-sectional area of the first portion; and a third portion positioned above the first portion and having a horizontal cross-sectional area greater than a horizontal cross-sectional area of the first portion, wherein the outlet opening is in communication with the second portion, and wherein the detecting portion is configured to detect the level of ink stored in the first portion.

11. The printing system according to claim 10, wherein the inlet opening is in communication with the first portion.

12. The printing system according to claim 10, wherein the predetermined position is below the inlet opening.

13. The printing system according to claim 10, wherein the second portion has a horizontal cross-sectional area greater than a horizontal cross-sectional area of the third portion.

14. The printing system according to claim 10, wherein the detecting portion comprises:

a prism, a vertical position of the prism is in coincidence with the predetermined position in the second storage chamber; and a light emitting portion configured to emit light toward the prism.

15. The printing system according to claim 14, further comprising a light receiving portion configured to receive light emitted from the light emitting portion and reflected from the prism when the ink stored in the second storage chamber is at a level equal to or lower than the predetermined position, wherein when the ink stored in the second storage chamber is at a level higher than the predetermined position, the light emitted from the light emitting portion passes through the prism and is not received at the light receiving portion, the light receiving portion producing an output depending upon whether the light is received or not.

16. The printing system according to claim 15, further comprising a notification portion configured to notify a user of whether the ink stored in the second storage chamber is at the level higher than the predetermined position or the level equal to or lower than the predetermined position in response to the output of the light receiving portion.

17. The printing system according to claim 10, wherein the first storage chamber comprises:

a fourth portion; and a fifth portion positioned below the fourth portion and having a horizontal cross-sectional area smaller than a horizontal cross-sectional area of the fourth portion, wherein the inlet opening permits the ink to flow from the fifth portion into the second storage chamber, and wherein the first portion has a portion positioned at a level same as a level of a portion of the fifth portion in the vertical direction, the portion of the first portion having a horizontal cross-sectional area greater than a horizontal cross-sectional area of the portion of the fifth portion.

18. The printing system according to claim 10, wherein a horizontal cross-sectional area of the first portion at a vertical height equal to the predetermined level is minimum with respect to the first portion.

* * * * *